United States Patent [19]

Marchesano et al.

[11] Patent Number: 4,873,180

[45] Date of Patent: Oct. 10, 1989

[54] DEVELOPER COMPOSITIONS FOR SILVER HALIDE PHOTOGRAPHIC MATERIALS COMPRISING CYCLIC AMINO METHANE DIPHOSPHONIC ACID COMPOUNDS

[75] Inventors: Carlo Marchesano; Franco Buriano; Enrico Furlanetto, all of Savona, Italy

[73] Assignee: Minnesota Mining and Manufacturing Company, St. Paul, Minn.

[21] Appl. No.: 178,251

[22] Filed: Apr. 6, 1988

[30] Foreign Application Priority Data

Apr. 13, 1987 [IT] Italy ..... 20087 A/87

[51] Int. Cl.[4] ..... G03C 5/30; G03C 7/16

[52] U.S. Cl. ..... 430/491; 430/489; 430/490; 430/484; 430/468; 430/601; 430/610; 430/613; 430/480

[58] Field of Search ..... 430/491, 489, 490, 484, 430/468, 601, 598, 607, 610, 613, 480

[56] References Cited

U.S. PATENT DOCUMENTS

| | | | |
|---|---|---|---|
| 3,201,246 | 8/1965 | Allen et al. | 430/491 |
| 3,994,730 | 11/1976 | Frank et al. | 430/491 |
| 4,172,728 | 10/1979 | Sincius et al. | 430/478 |
| 4,264,716 | 4/1981 | Vincent et al. | 430/491 |
| 4,482,626 | 11/1984 | Twist et al. | 430/380 |
| 4,588,677 | 5/1986 | Ishikawa et al. | 430/491 |
| 4,596,764 | 6/1986 | Ishimaru | 430/393 |
| 4,693,956 | 9/1987 | Marchesano | 430/266 |

FOREIGN PATENT DOCUMENTS 0136582 9/1983 European Pat. Off. .

OTHER PUBLICATIONS

Research Disclosure 18837, published Dec. 1979.

*Primary Examiner*—Paul R. Michl
*Assistant Examiner*—Patrick A. Doody
*Attorney, Agent, or Firm*—Donald M. Sell; Walter N. Kirn; Mark A. Litman

[57] ABSTRACT

The addition to an aqueous alkaline developer composition for silver halide photographic materials of a dialkylaminomethane diphosphonic acid compound sequestering agent increases the resistance of the developer composition against aerial oxidation and inhibits calcareous deposit formation.

13 Claims, No Drawings

DEVELOPER COMPOSITIONS FOR SILVER HALIDE PHOTOGRAPHIC MATERIALS COMPRISING CYCLIC AMINO METHANE DIPHOSPHONIC ACID COMPOUNDS

FIELD OF THE INVENTION

The present invention relates to developer compositions for silver halide photographic materials and, in particular, to developer compositions having a high sequestering power to metallic ions.

BACKGROUND OF THE ART

In general, the processing of silver halide photographic materials comprises the steps of development, fixing (or bleach-fixing) and washing.

Development is made by processing the light-exposed photographic material in an aqueous alkaline solution (composition) containing a developing agent.

In general, the developer solution, in addition to the developing agent, comprises other organic or inorganic compounds useful to improve its characteristics.

For example, aqueous alkaline developer solutions for preparing photographic black and white images with silver halide photographic materials (i.e. black and white developer solutions), in addition to developing agents (such as hydroquinone or a hydroquinone derivative), comprise auxiliary developing agents, antioxidants (such as alkaline metal sulfites), buffering agents, organic antifogging agents and inorganic or organic alkaline compounds.

Aqueous alkaline developer solutions for preparing photographic color images with silver halide photographic materials associated with image dye-forming couplers (i.e. color developer solutions), in addition to developing agents (such as p-phenylene diamine derivatives) comprise organic and inorganic antifogging agents, antioxidants (alkaline metal sulfites, hydroxylamine salts), buffering agents (such as borate, carbonate, phosphate salts) and inorganic or organic alkaline compounds.

In addition the above mentioned ingredients, both color and black-and-white developer solutions comprise sequestering agents which are capable of both preventing deposit formation and also increasing resistance to oxidation.

It is well-known that insoluble calcareous deposits, which damage photographic materials and processing apparatus, are formed if hard water due to the presence of $Ca^{++}$ and $Mg^{++}$ ions is used in the preparation of developer solutions. The presence of sequestering agents capable of complexing said polyvalent metal ions prevents said deposits from being formed.

Traces of other metal ions, such as iron and copper (which have been introduced into the developer solutions as impurities contained in water and chemical compounds used in developer solutions) are also known to have a catalytic effect on aerial oxidation of developing agents. Said metal ions, in the case of color developer solutions, have also the effect of catalyzing the decomposition of hydroxylamine salts used as antioxidants and causing adverse sensitometric effects. The addition of sequestering agents capable of complexing $Fe^{++}$ and $Cu^{++}$ ions has therefore the object of stabilizing the photographic developer solutions.

Nevertheless, a good sequestering agent for photographic developer solutions is difficult to find. As a matter of fact, sequestering agents useful in black and white developer solutions are not as effective in color developer solutions. Moreover, the use of sequestering agents in color developer solutions, containing hydroxylamine salts, presents considerable difficulties because such sequestering agents often tend to decompose the hydroxylamine salts. Still moreover, sequestering agents may negatively affect the sensitometric characteristics of the photographic materials processed in the developer solutions containing such sequestering agents.

Therefore, there is the need of overcoming said restrictions in the use of sequestering agents in photographic developer solutions and providing sequestering agents which make developer solutions resistant to aerial oxidation and deposit formation and can be used both in black and white developer solutions and in color developer solutions, particularly in the presence of hydroxylamine salts.

Research Disclosure 18837 describes various classes of sequestering agents such as polyphosphonic acid sequestering agents of the following formulas:

(1) amino-N,N-dimethylenephosphonic acids of the formula $$R_3—N(CH_2PO_3M_2)_2$$

wherein M is a hydrogen atom or a monovalent cation and $R_3$ is an alkyl group, an aryl group, an aralkyl group, an alkaryl group, an alicyclic group or a heterocyclic radical, and $R_3$ can be further substituted with substituents such as hydroxyl, halogen, an alkoxy group, a $—PO_3M_2$ group, a $—CH_2PO_3M_2$ group, or an $—N(CH_2PO_3M_2)_2$ group;

(2) hydroxyalkylidene diphosphonic acids of the formula

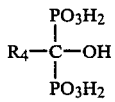

in which $R_4$ is an alkyl group, preferably of one to five carbon atoms, such as methyl, ethyl, n-propyl, isopropyl, n-butyl, n-pentyl, and the like;

(3) aminodiphosphonic acids of the formula

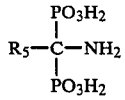

in which $R_5$ is an alkyl group, preferably of one to five carbon atoms; and (4) N-acyl-aminodiphosphonic acids of the formula

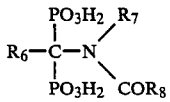

where $R_6$, $R_7$ and $R_8$ are hydrogen or an alkyl group, preferably alkyl of one to five carbon atoms.

U.S. Pat. No. 4,596,764 describes specific aminopolyphosphonic acid sequestering agents for use in color developers, namely: 1,3-diaminopropanol-N,N,N',N'-tetramethylenephosphonic acid, ethylenediamine- N,N,N',N'-tetramethylenephosphonic acid and 1,3-propylenediamine-N,N,N',N'-tetramethylenephosphonic acid.

SUMMARY OF THE INVENTION

The addition into an aqueous alkaline developer composition for silver halide photographic materials of a dialkylaminomethane diphosphonic acid compound sequestering agent increases the resistance of the developer composition against aerial oxidation and inhibits calcareous deposit formation.

Included among the sequestering agents advantageously used in developer compositions are those having the following formulas:

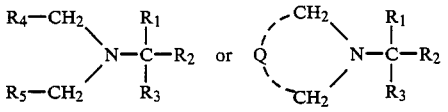

wherein $R_1$, $R_2$ and $R_3$, equal or different, each represent a hydrogen atom or a $PO_3M'M''$ group, wherein M' and M'' each represent a hydrogen atom, an alkaline metal such as Li, Na or K or a quaternary ammonium group such as ammonium, pyridinium, triethanolammonium or triethylammonium, and $R_4$ and $R_5$, equal or different, each represent a hydrogen atom, an alkyl group, a $PO_3M'M''$ or $PO_3M'M''$ substituted alkyl group group and Q represents the atoms or chemical bonds necessary to complete a 3- to 6-membered ring, with the proviso that at least two of $R_1$, $R_2$, $R_3$, $R_4$ and $R_5$ substituents represent a $PO_3M'M''$ group.

DETAILED DESCRIPTION OF THE INVENTION

The present invention relates to a developer composition for silver halide photographic materials comprising a dialkylaminomethane diphosphonic acid compound sequestering agent. According to the present invention, the term "dialkylamino" is intended to include both unsubstituted or substituted dialkylamino and cyclicamino groups. Said dialkylamino group preferably includes alkyl groups having from 1 to 5 carbon atoms, e.g. dimethylamino, diethylamino, dipropylamino, dibutylamino, N-methyl-N-propylamino, etc. Said cyclicamino group preferably represents a 3- to 6-membered ring, e.g. aziridino, pyrrolidino, imidazolidino, piperidino, piperazino, isoindolino, morpholino, etc. Suitable substituents of said dialkylamino and cyclicamino groups include an alkyl group, preferably a lower alkyl group, having 1 to 4 carbon atoms, e.g. methyl, ethyl, butyl, etc., a halogen atom, a nitro group, a cyano group, an aryl group, e.g. phenyl, naphthyl, etc., and alkoxy group, preferably a lower alkoxy group having 1 to 4 carbon atoms, e.g. methoxy, ethoxy, methoxyethoxy, etc., an aryloxy group, e.g. phenoxy, 4-hydroxyphenoxy, naphthoxy, etc., an acyloxy group, e.g. acetyloxy, benzoyl, etc., a sulfamoyl group, e.g. N-ethylsulfamoyl, etc., an acylamino group, e.g. acetylamino, benzamino, etc., a diacylamino group, e.g. succinimido, hydantoinyl, etc., a ureido group, e.g. methylureido, phenylureido, etc., a sulfonamido group, e.g. methanesulfonamido, methoxyethanesulfonamido, etc., a hydroxy group, a phosphonic group, a carboxy group, an alkylcarbonyl group, e.g. acetyl, etc., an arylcarbonyl group, e.g. benzoyl, an alkoxycarbonyl group, e.g. methoxycarbonyl, benzyloxycarbonyl, etc., an aryloxycarbonyl group, e.g. phenoxycarbonyl, p-tolyloxycarbonyl, etc., a carbamoyl group, e.g. N-ethylcarbamoyl, etc., a heterocyclic group, a mercapto group, an alkylthio group, an arylthio group, an alkylsulfonyl group, an arylsulfonyl group, an acyl group, an aralkyl group.

Particularly, the present invention relates to a developer composition for silver halide photographic materials comprising a dialkylaminomethane diphosphonic acid of the following formulas:

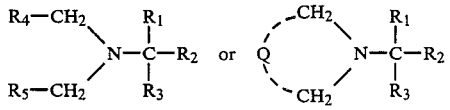

wherein $R_1$, $R_2$ and $R_3$, equal or different, each represent a hydrogen atom or a $PO_3M'M''$ group, wherein M' and M'' represent a hydrogen atom, an alkaline metal such as Li, Na or K or a quaternary ammonium group such as ammonium, pyridinium, triethanolammonium or triethylammonium, $R_4$ and $R_5$, equal or different, each represent a hydrogen atom, an alkyl group, a $PO_3M'M''$ group or a $PO_3M'M''$ substituted alkyl group and Q represents the atoms or chemical bonds necessary to complete a 3- to 6-membered ring, with the proviso that at least two of $R_1$, $R_2$, $R_3$, $R_4$ and $R_5$ groups represent a $PO_3M'M''$ group.

In one preferred aspect, two of $R_4$ and $R_5$ above each represent a $PO_3M'M''$ group when only one of $R_1$, $R_2$ and $R_3$ represents a $PO_3M'M''$ group.

The groups represented by $R_4$, $R_5$ and Q may be either unsubstituted or substituted. The nature and size of said groups, as well as the nature and size of their substituents are those described above.

Typical examples of sequestering agents within the general formula above are:

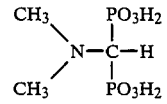

(1)

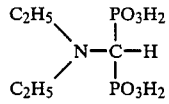

(2)

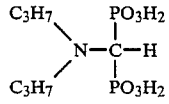

(3)

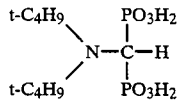

(4)

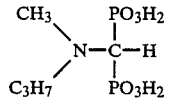

(5)

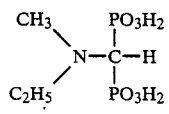

(6)

-continued (7)

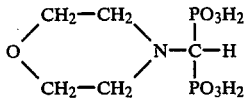

(8)

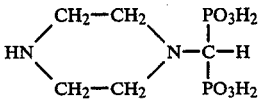

(9)

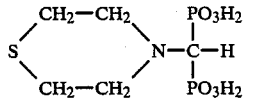

(10)

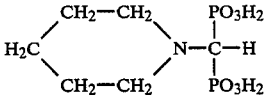

(11)

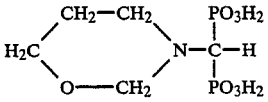

(12)

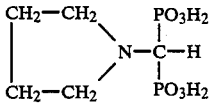

(13)

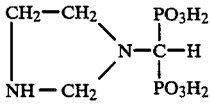

(14)

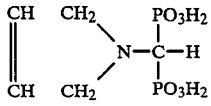

(15)

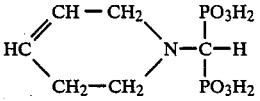

(16)

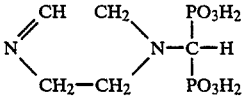

(17)

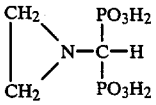

(18)

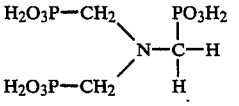

(19)

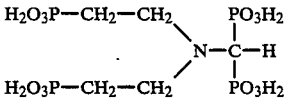

(20)

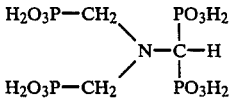

-continued (21)

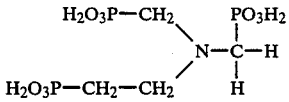

Preferred examples of sequestering agents within the formulas above are compounds (7) and (18).

Said sequestering agents can be advantageously used in amounts of about $2\times10^{-4}$ to about 0.5 moles per liter, preferably of about $9\times10^{-3}$ to about 0.1 moles per liter of developer composition.

With developer composition, for the purpose of calculating the amounts of the various components, we mean herein a developer composition ready for use and not a concentrated solution from which a developer composition ready for use is obtained by diluting with water or another aqueous composition.

The above sequestering agents can be used in combination with sequestering agents known in the art such as, for example, aminopolycarboxylic acids (ethylenediaminotetracetic acid, diethylenetriaminopentacetic acid, etc.), aminopolyphosphonic acids (methylaminophosphonic acid, phosphonic acids described in Research Disclosure 18837 of December 1979, phosphonic acids described in U.S. Pat. No. 4,596,764, etc.), polyphosphate compounds (sodium hexametaphosphate, etc.), α-hydroxycarboxylic acid compounds (lactic acid, etc.), dicarboxylic acid compounds (malonic acids, etc.), α-ketocarboxylic acid compounds (pyruvic acid, etc.), alkanolamine compounds (diethanolamine, etc.), etc.

Preferably, the above described sequestering agents can be used in developer compositions of the present invention in combination with an aminopolycarboxylic acid compound or a water-soluble salt thereof.

Aminopolycarboxylic acid compounds useful in combination with the above sequestering agents are, for example, nitrilotriacetic acid (NTA), diaminopropanoltetracetic acid (DPTA) and diethylenetriaminopentacetic acid (DTPA). Water-soluble salts of aminopolycarboxylic acid compounds are, for example, sodium, potassium, pyridinium, triethanolammonium and triethylammonium salts.

Said aminopolycarboxylic acid compounds are advantageously used in amounts of about $2\times10^{-4}$ to about 0.1 moles per liter, preferably of about $3\times10^{-4}$ to about $2.5\times10^{-1}$ moles per liter of developer composition.

The sequestering agents of the present invention, incorporated both into color and black-and-white developer compositions, have been found to prevent the formation of calcareous deposits, to stabilize said compositions against aerial oxidation and to lower hydroxylamine salt degradation ( in color developer compositions) even if heavy metals (iron and copper) ions are present.

According to a particular aspect, the above described developer composition is a developer composition for obtaining black and white images upon development of lightexposed silver halide photographic materials (for example Rapid Access materials, X-Ray materials, printing papers, negative and reversal materials). Generally, it comprises a black and white developing agent, an antioxidant, an antifogging agent and organic or inorganic alkaline agents.

Black and white developing agents for use in the present invention include hydroquinone and hydroquinone derivatives (for example t-butylhydroquinone, methylhydroquinone, dimethylhydroquinone, chlorohydroquinone, dichlorohydroquinone, bromohydroquinone, 1,4-dihydroxynaphthalene, methoxyhydroquinone, ethoxyhydroquinone, etc.). Hydroquinone, however, is preferred. Said black and white developing agents are generally used in amounts from about 0.040 to about 0.70 moles per liter, preferably from about 0.08 to about 0.40 moles per liter of developer composition.

Said black and white developing agents can be used alone or in combination with auxiliary developing agents which show a superadditive developing effect, such as p-aminophenol and p-aminophenol derivatives (such as N-methyl-p-aminophenol or metol and 2,4-diaminophenol) and pyrazolidone compounds (such as 1-phenyl-3-pyrazolidone or phenidone) and pyrazolidone derivatives (such as 4-methyl-1-phenyl-3-pyrazolidone and 4,4'-dimethyl-1-phenyl-3-pyrazolidone). Phenidone however is preferred. Said auxiliary developing agents are generally used in amounts from about 0.0001 to about 0.15 moles per liter, preferably from about 0.0005 to about 0.01 moles per liter of developer composition.

Antioxidants are generally alkaline metal sulfites, for example sodium sulfite and potassium metabisulfite or sulfite ion generators, such as aldehyde bisulfite adducts, for example, sodium formaldehyde bisulfite. They are used in amounts from about 0.001 to about 1 mole per liter, preferably from about 0.08 to about 0.7 mole per liter of developer composition.

Organic antifogging agents, which are known in the art to remove fog in processed photographic materials, useful in the developer compositions of the present invention include benzimidazole, benzotriazole, tetrazole, indazole, thiazole derivatives, etc. Preferred antifogging agents include 5-nitroindazole, denzimidazole nitrate, 5-nitrobenzotriazole, 1-phenyl-5-mercaptotetrazole and benzotriazole. Said compounds are used, alone or in combination, in amounts from about $1\times10^{-5}$ to about $5\times10^{-2}$ moles per liter, preferably from about $5\times10^{-4}$ to about $1\times10^{-2}$ moles per liter of developer composition.

In the developer compositions there are used inorganic alkaline agents to obtain the preferred pH value which is usually above 10. Said inorganic alkaline agents include KOH, NaOH, LiOH, sodium and potassium carbonate, etc.

In addition to inorganic alkaline agents, developer compositions also can be brought to optimum pH with organic alkaline agents, such as amino compounds, preferably alkanolamine compounds (for example ethanolamine, diethanolamine, triethanolamine, etc., as described in EP patent application S.N. 32,456). Said organic alkaline agents, as known in the art, have beneficial effects also on the stability of the developer composition, as described for example in U.S. Pat. No. 4,172,728 and EP patent application S.N. 136,582. The developer compositions of the present invention may advantageously include compounds containing a hydroxymethylidene group as described in EP patent application S.N. 182,293, such as for example ethyl alcohol, 1,3-butanediol, phenylmethylcarbinol and benzhydrol.

The black and white developer compositions, as known in the art, can contain other ingredients in addition to the above described compounds. For example inorganic antifogging agents, such as water-soluble halides (for example KBr and NaBr), water-miscible organic solvents, buffering agents (for example borates, carbonates and fosfates), developing accelerators, etc.

According to another particular aspect, the developer composition comprising the sequestering agents according to the present invention is a developer composition to obtain color images upon development of light-exposed silver halide color photographic materials.

It is known that color photographic images can be formed by image-wise reacting (coupling) the oxidation products of the color developing agents with color forming compounds (couplers) to form dyes, such as indoaniline, indophenole and azomethine dyes. Normally (in the substractive process for the formation of color images), cyan, magenta and yellow dye forming couplers are used, which dyes are complementary to the primary colors, viz. red, green and blue, respectively. Phenolic or naphtholic type couplers are generally used to form cyan dyes, pyrazolone, cyanoacetilic and pyrazolo-triazole type couplers to form magenta dyes and acylacetanilide couplers to form yellow dyes. The couplers can be incorporated either into the developing solutions or in the silver halide emulsion layers of the photographic materials. The couplers incorporated into the developing solutions are of the diffusing type. The couplers incorporated into the photographic materials are of the non-diffusing type and, according to the desired use, can either form non-diffusing or diffusing dyes.

The color developer compositions according to the present invention generally comprise a color developing agent, an anitoxidant and a hydroxylamine salt.

The color developing agents include the primary aromatic amine derivatives. Particularly useful color developing agents are the p-phenylene diamine derivatives, above all the N,N-dialkyl-p-phenylene diamine derivatives wherein the alkyl groups or the aromatic nucleus can be substituted or not substituted.

Examples of p-phenylene diamine developers include the salts of: N,N-diethyl-p-phenylene diamine, 2-amino-5-diethylaminotoluene, 4-amino-N-ethyl-N-(β-methanesulfonamidoethyl)-m-toluidine, 4-amino-3-methyl-N-ethyl-N-(β-hydroxyethyl)-aniline, 4-amino-3-(β-methylsulfonamidoethyl)-N,N-diethylaniline, 4-amino-N,N-diethyl-3-(N'-methyl-β-methylsulfonamido)-aniline, N-ethyl-N-methoxyethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic materials), 4-amino-N-ethyl-N-(β-methanesulfonamidoethyl)-m-toluidine sesquisulfate monohydrate (generally known as CD3 and used in the developing solutions for photographic papers and color reversal materials) and 4-amino-3-methyl-N-ethyl-N-(β-hydroxyethyl)-aniline sulfate (generally known as CD4 and used in the developing solutions for color negative photographic materials).

Said color developing agents are generally used in a quantity from about $1\times10^{-3}$ to about 0.1 moles per liter, preferably from about $4.5\times10^{-3}$ to about $3\times10^{-2}$ moles per liter of color developer composition.

The antioxidants of the color developer compositions include the compounds known in the art and above all sulfites. With sulfites we mean herein those compounds capable of generating sulfite ions in a water solution, for instance alkali metal sulfites, bisulfites and metabisulfites, such as sodium sulfite and potassium metabisulfite.

The quantity of the sulfite compound with respect to the color developing agent preferably exceeds a molar ratio of 1.5:1 and, more preferably, of at least 2:1.

Other antioxidants, such as ascorbic acid, stereoisomers and diastereoisomers of ascorbic acid and its derivatives, glycine, hydroxyacetone, carbohydrazide, etc., can be used in addition to sulfite in order to lengthen or improve the stability of the aqueous alkaline color developer composition. For instance, useful ascorbic acid/developing agent proportions preferably range from 0.01:1 to 0.1:1 and, more preferably, from 0.02:1 to 0.05:1.

Other antioxidants useful in the color developer compositions of the present invention include hydroxylamine salts, for instance hydroxylamine hydrochlorate, sulfate and phosphate, as known in the art. They are used in a quantity ranging from $1.5\times10^{-4}$ to about 1 mole per liter, preferably from about $5\times10^{-2}$ to about $2\times10^{-1}$ moles per liter of developer composition.

In addition to the color developing agents, antioxidants and sequestering agents of the present invention, the color developer compositions may contain other components as known in the art, for instance inorganic and organic alkaline agents (such as alkanolamines, as said above), alkali metal thiocyanates, alkali metal bromides, iodides and chlorides, benzyl alcohol, water-miscible organic solvents, thickening agents, etc. The pH value of both color and black-and-white aqueous composition generally is above 7, more typically ranges from 10 to 13.

The photographic developer compositions ready for use with the present invention, comprising the developing agents, antioxidants, sequestering agents as described above and all other additional components as known in the art can be prepared starting from one or more concentrated compositions which can be easily mixed with water. Since a single concentrated composition of the developer composition ready for use is difficult to be made (due to problems of solubility and stability), it is normal practice dividing and packaging the developer composition in more compositions comprising groups of the various components which can be easily mixed with water to prepare the developer compositions ready for use, as described for instance in U.S. Pat. Nos. 3,038,801; 3,615,572; 3,814,606; 4,232,113 and 4,501,812.

The present invention is now described with reference to the following examples.

EXAMPLE 1

Two aqueous alkaline photographic developer compositions (A and B) ready for use having the following formulation were prepared for developing color photographic papers comprising silver halide emulsion layers and couplers incorporated therein:

| | | A | B |
|---|---|---|---|
| Water | ml | 800 | 800 |
| Ethylene glycol | g | 37.4 | 42.4 |
| Benzyl alcohol | g | 15.3 | 14.0 |
| Tinopal TM SFP (optical brightener of Ciba-Geigy) | g | 0.6 | 0.4 |
| Ascorbic acid | g | 0.0256 | 0.0256 |
| $NH_2OH.HCl$ | g | 1.7 | 1.7 |
| KBr | g | 0.6 | 0.6 |
| KCl | g | 0.5 | 0.5 |
| $K_2S_2O_5$ | g | 1.6 | 1.6 |
| DTPA acid | g | 1.3 | — |
| DPTA acid | g | 1.2 | 0.5 |
| Compound (7) (40% w/w sol.) | g | — | 3.0 |
| KOH (37% w/w sol.) | g | 7 | 12 |
| $K_2CO_3$ | g | 26 | 21 |
| $KHCO_3$ | g | 3.8 | 3.8 |
| $CD_3.H_2O$ | g | 5.6 | 5.6 |
| Water to make | ml | 1,000 | 1,000 |
| pH at 25° C. | | 10.25 | 10.25 |

The sequestering power with respect to $Ca^{++}$ and $Fe^{++}$ ions of the two developer compositions was measured through spectrophotometric atomic absorption determination of the chelated quantities. The following Table 1 reports the ppm (part per million) values of the sequestered $Ca^{++}$ and $Fe^{++}$ ions.

TABLE 1

| | A | B |
|---|---|---|
| ppm $Ca^{++}$ | 320 | 385 |
| ppm $Fe^{++}$ | 480 | 500 |

Samples of Kodak Plus color photographic paper (which is suitable for a high temperature processing such as Kodak LOOR processing at 39° C.) were exposed through a 0.30 step wedge with an exposure time of 1/20" and a lamp having a color temperature of 2,850° K. The exposed samples were processed in the following manual processing line at 39° C.:

| | |
|---|---|
| Color development | 3'30" |
| Bleach-fixing | 1'30" |
| Washing | 3'30" |
| Drying | 5' |

The bleach-fixing bath had a the following composition:

| | | |
|---|---|---|
| Water | ml | 800 |
| Acetic acid | g | 1.25 |
| $(NH_4)_2S_2O_3$ (60% w/w solution) | g | 135 |
| $Na_2S_2O_5$ | g | 13.9 |
| $EDTA.NH_4.Fe$ | g | 51 |
| EDTA | g | 7.35 |
| Water to make | ml | 1,000 |
| pH at 20° C. | | 6.6 |

Samples of the above mentioned color paper were exposed and processed by using Kodak MX 1247-1 color developer composition.

Samples of the same paper were exposed under the same conditions and processed in the developer composition A.

Samples of the same paper were exposed under the same conditions and processed in the developer composition B.

The following Table 2 reports the sensitome- tric data of yellow, magenta and cyan layers.

TABLE 2

| Developer composition | Dmax | Average contrast | Sensitivity | Fog |
|---|---|---|---|---|
| | (YELLOW LAYER) | | | |
| Kodak MX 1247-1 | 2.47 | 2.86 | 2.71 | 0.10 |
| A | 2.44 | 2.90 | 2.72 | 0.09 |
| B | 2.36 | 2.92 | 2.66 | 0.11 |
| | (MAGENTA LAYER) | | | |
| Kodak MX 1247-1 | 2.51 | 3.03 | 2.57 | 0.12 |
| A | 2.53 | 3.60 | 2.62 | 0.10 |
| B | 2.43 | 3.12 | 2.53 | 0.11 |
| | (CYAN LAYER) | | | |
| Kodak MX 1247-1 | 2.64 | 3.33 | 2.50 | 0.12 |
| A | 2.62 | 3.59 | 2.49 | 0.11 |
| B | 2.57 | 3.45 | 2.46 | 0.12 |

The experiment shows how color balance in samples processed with Kodak MX 1247-1 developer composition and in those processed with B developer composition results substantially the same. The samples processed in A developer composition, on the contrary, show a strong variation as regards above all contrast in magenta layer.

EXAMPLE 2

Two concentrated aqueous compositions (C and D) were prepared with the following formulation:

| | | C | D |
|---|---|---|---|
| Water | ml | 535 | 535 |
| Sodium sulfite | g | 25.7 | 25.7 |
| Sodium formaldehyde bisulfite | g | 300 | 300 |
| DPTA acid | g | 3 | — |
| Compound (7) (40% w/w sol.) | g | — | 3 |
| Carbowax TM 1540 Fluka | g | 1 | 1 |
| Triethylene glycol | g | 218 | 218 |
| Hydroquinone | g | 89 | 89 |
| Water to make | ml | 1,000 | 1,000 |
| pH at 20° C. | | 7.15 | 7.45 |

A third concentrated composition (E) was prepared with the following formulation:

| | | E |
|---|---|---|
| Water | ml | 800 |
| Sodium Hydrate (30% w/w sol.) | g | 22.3 |
| Potassium carbonate | g | 252 |
| NTA acid.3Na.$H_2O$ | g | 7 |
| Borax | g | 35.7 |
| Sodium bromide | g | 8.6 |
| 1-phenyl-5-mercaptotetrazole | g | 0.015 |
| Water to make | ml | 1,000 |
| pH at 20° C. | | 12.00 |

The following two developing solutions ready for use (F and G) were prepared by using the above described concentrated compositons.

| | | F | G |
|---|---|---|---|
| Water | ml | 800 | 800 |
| Solution C | ml | 200 | — |
| Solution D | ml | — | 200 |
| Solution E | ml | 200 | 200 |
| pH at 20° C. | | 10.11 | 10.12 |

The sequestering power of the two developing solutions with respect to $Ca^{++}$ and $Fe^{++}$ ions was measured as described in Example 1.

The following Table 3 reports the ppm values of the sequestered $Ca^{++}$ and $Fe^{++}$ ions.

TABLE 3

| | F | G |
|---|---|---|
| ppm $Ca^{++}$ | 137 | 220 |
| ppm $Fe^{++}$ | 207 | 205 |

Although Composition G of the present invention has $4.9\times10^{-3}$ moles per liter of Sequestering Compound (7), it has an improved sequestering power with respect to comparison composition F which contains $9.3\times10^{-3}$ moles per liter of DPTA sequestering agent.

Samples of 3M Graphic Arts Control Strips (which are pre-exposed photographic material samples to be used for the control of Lith processing) were developed with compositions F and G respectively for 2'15" at 22° C., then fixed in 3M Fix Roll fixer for 5' at 22° C. and washed with water for 10' at 22° C. The samples developed in Composition F as well as those developed in Composition G exhibited equivalent sensitometric characteristics (maximum density, contrast, sensitivity and fog).

EXAMPLE 3

Three aqueous alkaline photographic developer compositions ready for use (H, I and L) having the following formulation were prepared to develop color negative photographic materials having silver halide emulsion layers and couplers incorporated therein.

| | | H | I | L |
|---|---|---|---|---|
| Water | ml | 750 | 750 | 750 |
| KOH (37% w/w sol.) | ml | 1.63 | 1.63 | 1.63 |
| $Na_2SO_3$ | g | 0.23 | 0.23 | 0.23 |
| NTA.3Na.$H_2O$ acid | g | 0.55 | — | — |
| DPTA acid | g | 2.50 | — | — |
| Compound (7) (40% w/w solution) | g | — | 5 | 10 |
| $K_2CO_3$ | g | 36 | 36 | 36 |
| $KHCO_3$ | g | 2.1 | 2.1 | 2.1 |
| NaBr | g | 0.9 | 0.9 | 0.9 |
| KCl | g | 0.43 | 0.43 | 0.43 |
| $NH_2OH.\frac{1}{2}H_2SO_4$ | g | 2.85 | 2.85 | 2.85 |
| $K_2S_2O_5$ | g | 4 | 4 | 4 |
| CD4 | g | 5.30 | 5.30 | 5.30 |
| Water to make | ml | 1,000 | 1,000 | 1,000 |
| pH at 20° C. | | 10.1 | 10.1 | 10.1 |

The sequestering power of the three developer compositions with respect to $Ca^{++}$ and $Fe^{++}$ ions was measured as described in Example 1.

The following Table 4 reports the ppm values of the sequestered $Ca^{++}$ and $Fe^{++}$ ions.

TABLE 4

| | H | I | L |
|---|---|---|---|
| ppm $Ca^{++}$ | 275 | 300 | 674 |
| ppm $Fe^{++}$ | 170 | 832 | 1755 |

3M 100 ASA color negative photographic materials, exposed through a 0.30 step wedge to a lamp having a color temperature of 5500° K., were developed with Compositions H, I and L, respectively, for 3'15" at 38° C., then processed in 3M CNP4 bleaching bath for 6'30" at 38° C., washed with current water for 3'15" at 38° C., fixed in 3M CNP4 fixing bath for 6'30" at 38° C., washed with current water for 3'15" at 38° C. and processed in 3M CNP4 stabilizing bath for 1'30" at 38° C. The materials developed with Composition H as well as those developed with Compositions I and L exhibited sensitometric characteristics (maximum density, contrast, sensitivity and fog) equivalent and in accordance with the subject photographic material standards.

EXAMPLE 4

Two developer compositions for color photographic papers (M and N) were prepared with the following formulation:

| | | M | N |
|---|---|---|---|
| Water | ml | 2,500 | 2,500 |
| KOH (35% w/w sol.) | g | 730 | 660 |
| DTPA acid | g | 120 | 30 |
| DPTA acid | g | 90 | — |
| Compound (7) (40% w/w sol.) | g | — | 300 |
| $K_2S_2O_5$ | g | 200 | 200 |
| $K_2CO_3$ | g | 3,200 | 3,200 |
| Water to make | ml | 5,000 | 5,000 |

A third concentrated composition (P) was prepared with the following formulation:

| | | |
|---|---|---|
| Ethylene glycol | g | 4,675 |
| Ascorbic L(+) acid | g | 3.2 |
| Tinopal TM SFP (Ciba-Geigy) | g | 60 |
| Benzyl alcohol | g | 1882.8 |
| CD3·$H_2O$ | g | 620 |
| $NH_2OH$·HCl | g | 215 |
| Ethylene glycol to make | ml | 6,600 |

Two developer compositions ready for use (Q and R) for color photographic papers of the following formulation were prepared by using the concentrated compositions described above.

| | | Q | R |
|---|---|---|---|
| Water | ml | 850 | 850 |
| Composition P | ml | 52.8 | 52.8 |
| Composition M | ml | 40 | — |
| Composition N | ml | — | 40 |
| 3M CPP-2 Starter | ml | 25 | 25 |
| Water to make | ml | 1,000 | 1,000 |
| pH at 20° C. | | 10.25 | 10.25 |

The sequestering power of the two compositions Q and R, both fresh and after having worked in an automatic processor to replace the volume of the developing solution in the tank at least 5 times with a fresh solution of replenisher (called working composition), with respect to $Ca^{++}$ and $Fe^{++}$ ions was measured as described in Example 1.

The following table reports the ppm values of the sequestered $Ca^{++}$ and $Fe^{++}$ ions.

TABLE 5

| | Composition Q | | Composition R | |
|---|---|---|---|---|
| | fresh | working | fresh | working |
| ppm $Ca^{++}$ | 205 | 195 | 210 | 230 |
| ppm $Fe^{++}$ | 220 | 200 | 490 | 575 |

EXAMPLE 5

Samples of 3M Type 25 color paper were exposed through a 0.30 step wedge for 1/20" to a lamp having a color temperature of 2850° K. The samples were developed with compositions Q and R of Example 4, fresh (just prepared), oxidized (after a week in a container in direct contact with air) and as working composition, for 3'30" at 32.8° C., then processed in a 3M CPP-2 bleach-fixing bath for 1'30" at 32.8° C., washed with tap water for 3'30" at 32.8° C. and finally dried for 5' at about 80° C.

Table 6 reports the maximum (Max) and minimum (Min) values of average contrast (Γ) and sensitivity (Sens) and the difference thereof (δ) obtained with the developer compositions under different conditions (fresh, working, oxidized).

TABLE 6

| | | Yellow layer | | Magenta layer | | Cyan layer | |
|---|---|---|---|---|---|---|---|
| | | Γ | Sens. | Γ | Sens. | Γ | Sens. |
| Comp. Q | Max | 2.37 | 2.53 | 3.09 | 2.46 | 3.21 | 2.48 |
| | Min | 2.15 | 2.48 | 2.28 | 2.31 | 2.26 | 2.35 |
| | δ | 0.22 | 0.05 | 0.81 | 0.15 | 0.95 | 0.13 |
| Comp. R | Max | 2.40 | 2.53 | 2.95 | 2.45 | 2.93 | 2.47 |
| | Min | 2.22 | 2.51 | 2.19 | 2.31 | 2.20 | 2.33 |
| | δ | 0.18 | 0.02 | 0.76 | 0.14 | 0.73 | 0.14 |

The experiment was repeated by using samples of Kodak PLUS color paper.

Table 7 reports the sensitometric data.

TABLE 7

| | | Yellow layer | | Magenta layer | | Cyan layer | |
|---|---|---|---|---|---|---|---|
| | | δ | Sens. | δ | Sens. | δ | Sens. |
| Comp. Q | Max | 3.03 | 2.55 | 2.78 | 2.44 | 2.96 | 2.35 |
| | Min | 2.23 | 2.48 | 2.40 | 2.35 | 2.60 | 2.26 |
| | δ | 0.80 | 0.07 | 0.38 | 0.09 | 0.36 | 0.09 |
| Comp. R | Max | 2.98 | 2.53 | 2.65 | 2.41 | 2.88 | 2.35 |
| | Min | 2.28 | 2.49 | 2.33 | 2.36 | 2.63 | 2.27 |
| | δ | 0.70 | 0.04 | 0.32 | 0.05 | 0.15 | 0.08 |

A comparison between δ values of Tables 6 and 7 shows that developer composition R of the present invention gives δ values lower than composition Q. In the color balance of a color print, this means a lower variation of the sensitometric values even with developer compositions which have worked for a long time.

EXAMPLE 6

An aqueous alkaline photographic developer composition of the prior art (S), ready for use to develop color photographic paper elements comprising silver halide emulsion layers and couplers incorporated therein, was prepared having the following formulation:

| | | |
|---|---|---|
| Water | ml | 800.0 |
| Triethanolamine | ml | 11.0 |
| Nonylphenoxy polyglycidol (50% w/w sol) | ml | 0.2 |
| Benzyl alcohol | ml | 18.0 |
| Kodak Ektaprint TM 2 stain reducing agent | g | 1.0 |
| LiCl | g | 2.1 |
| $NH_2OH \cdot \frac{1}{2}H_2SO_4$ | g | 4.0 |
| $K_2SO_3$ | g | 2.37 |
| Hydroxyethylidenediphosphonic acid (60% w/w sol.) | ml | 0.8 |
| CD3·$H_2O$ | g | 6.50 |

-continued

| | | |
|---|---|---|
| KOH (45% w/w/ sol.) | ml | 4.9 |
| $K_2CO_3$ | g | 28.0 |
| Water to make | ml | 1,000 |
| pH at 20° C. | | 10.35 |

An aqueous alkaline photographic developer composition of the present invention (T) was prepared having the following compostion:

| | | |
|---|---|---|
| Water | ml | 800 |
| Ethylene glycol | g | 47.0 |
| Benzyl alcohol | g | 18.82 |
| Tinopal TM SFP (Ciba-Geigy) | g | 0.6 |
| Ascorbic acid | g | 0.032 |
| $NH_2OH{\cdot}HCl$ | g | 2.15 |
| KBr | g | 0.6 |
| KCl | g | 0.5 |
| $K_2S_2O_5$ | g | 2.0 |
| Compound (7) (40% w/w sol.) | g | 5.0 |
| KOH (35% w/w sol.) | g | 6.6 |
| $K_2CO_3$ | g | 32.0 |
| $KHCO_3$ | g | 3.8 |
| $CD_3{\cdot}H_2O$ | g | 6.2 |
| Water to make | ml | 1,000 |
| pH at 20° C. | | 10.45 |

The sequestering power of the two developing solutions with respect to $Ca^{++}$ and $Fe^{++}$ ions was measured as described in Example 1.

The following Table 8 reports the ppm values of the sequestered $Ca^{++}$ and $Fe^{++}$ ions.

TABLE 8

| | S | T |
|---|---|---|
| ppm $Ca^{++}$ | 157 | 442 |
| ppm $Fe^{++}$ | 920 | 1040 |

The above results are significant also in view of the fact that the sequestering values associated with the present invention have been obtained in the absence of triethanolamine which is known to be a good sequestering agent for divalent iron ions.

We claim:

1. An alkaline aqueous developer composition for silver halide photographic materials which comprises a silver halide developing agent and a cyclicaminomethane diphosphonic acid compound sequestering agent.

2. An alkaline aqueous developer composition for silver halide photographic materials of claim 1 wherein said cyclicaminomethane diphosphonic acid compound corresponds to the following formula:

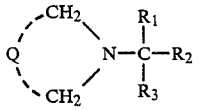

wherein $R_1$, $R_2$ and $R_3$, equal or different, each represent a hydrogen atom or a $PO_3M'M''$ group, wherein M' and M'' represent a hydrogen atom, an alkaline metal or a quaternary ammonium group, and Q represents the atoms or chemical bonds necessary to complete a 3- to 6-membered ring, with the proviso that at least two of $R_1$, $R_2$, and $R_3$ substituents represent a $PO_3M'M''$ group.

3. The alkaline aqueous developer composition for silver halide photographic materials of claim 1 wherein the sequestering agent corresponds to the formula:

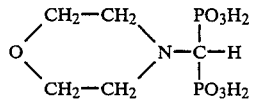

4. The alkaline aqueous developer composition for silver halide photographic materials of claim 1 which comprises a sequestering agent of the aminopolycarboxylic acid type.

5. The alkaline aqueous developer composition for silver halide photographic materials of claim 1 which comprises a sequestering agent of the nitrilotriacetic acid, diaminopropanoltetracetic acid and diethylenetriaminopentacetic acid type.

6. The alkaline aqueous developer composition of claim 1 for the preparation of color photographic images which comprises a color developing agent, an antioxidant and a hydroxylamine salt.

7. The alkaline aqueous developer composition of claim 6 wherein the color developing agent is a primary aromatic amine derivative.

8. The alkaline aqueous developer composition of claim 7 wherein the color developing agent is a N,N-diethyl-p-phenylene diamine, 2-amino-5-diethylaminotoluene, 4-amino-N-ethyl-(β-methanesulfonamidoethyl)-m-toluidine, 4-amino-3-methyl-N-ethyl-N-(β-hydroxyethyl)-aniline, 4-amino-3-(β-methylsulfonamidoethyl)-N,N-diethyl-aniline, 4-amino-N,N-diethyl-3-(N-methyl-β-methylsulfonamido)aniline and N-ethyl-N-methoxyethyl-3-methyl-p-phenylene diamine salt.

9. The alkaline aqueous developer composition of claim 6 wherein the antioxidant is an alkali metal sulfite.

10. The alkaline aqueous developer composition of claim 1 for the preparation of black-and-white photographic images which comprises a developing agent of the dihydroxybenzene type, an antioxidant and an organic antifogging agent.

11. The alkaline aqueous developer composition of claim 10 which comprises an auxiliary developing agent selected within the class of pyrazolidone and p-aminophenol compounds.

12. The alkaline aqueous developer composition of claim 10 wherein the antioxidant compound is an alkali metal sulfite.

13. The alkaline aqueous developer composition of claim 10 wherein the organic antifogging agent is selected within the 5-nitroindazole, benzimidazole nitrate, 1-phenyl-5-mercaptotetrazole and benzimidazole group.

* * * * *